US005241819A

United States Patent [19]

Ta

[11] Patent Number: 5,241,819

[45] Date of Patent: Sep. 7, 1993

[54] TAPPET VALVE ASSEMBLY FOR AUTOMATIC RAILWAY VEHICLE COUPLERS

[75] Inventor: Cuong M. Ta, Taylors, S.C.

[73] Assignee: Westinghouse Air Brake Company, Wilmerding, Pa.

[21] Appl. No.: 906,336

[22] Filed: Jun. 30, 1992

[51] Int. Cl.[5] ..... F16D 31/00

[52] U.S. Cl. ..... 60/325; 60/721; 91/508; 91/444; 213/75 R

[58] Field of Search ..... 91/508, 444, 428, 427, 91/448, 453; 60/721, 32 T; 213/75 R

[56] References Cited

U.S. PATENT DOCUMENTS

| | | | |
|---|---|---|---|
| 2,161,216 | 6/1939 | Wood | 91/444 |
| 4,033,233 | 7/1977 | Toi | 91/448 X |
| 4,246,832 | 1/1981 | Hofer et al. | 91/444 |
| 4,920,861 | 5/1990 | Lorimor | 91/448 X |
| 5,014,596 | 5/1991 | Martin | 91/427 X |
| 5,067,389 | 11/1991 | Germain | 91/448 X |

FOREIGN PATENT DOCUMENTS

| | | | |
|---|---|---|---|
| 2099926 | 12/1982 | United Kingdom | 91/444 |

*Primary Examiner*—Edward K. Look
*Assistant Examiner*—Hoang Nguyen
*Attorney, Agent, or Firm*—G. J. Falce

[57] ABSTRACT

A tappet valve arrangement for a railway car coupler having a main valve for supplying air pressure from one railway car to another coupled railway car. A piston and cylinder valve for supplying air pressure to a coupler centering device when the railway is in an uncoupled state and for interrupting the flow of air to the coupler centering device when the railway car is in a coupled state. A negating spool valve for overriding the flow of air to the coupler centering device when the railway car is in an uncoupled state. A shut-off valve for interrupting the supply of air from one railway car to another railway car when it is desired to uncouple the railway cars.

21 Claims, 4 Drawing Sheets

TAPPET VALVE ASSEMBLY FOR AUTOMATIC RAILWAY VEHICLE COUPLERS

FIELD OF THE INVENTION

This invention relates to a pneumatic control device for centering an uncoupled car coupler and for providing air pressure to a following coupled car coupler, and more particularly, to a tappet valve assembly for controlling the center position of an automatic railway car coupler which may be manually overridden when it is necessary to couple a pair of railway cars on a curve and for supplying air pressure to a subsequent railway car when coupled to a preceding railway car.

BACKGROUND OF THE INVENTION

Normally, automatic car couplers that are used on mass and/or rapid transit vehicles permit the effective mechanical coupling and uncoupling of adjacent vehicles and also allow the efficacious connection and disconnection of the electrical trainline and the pneumatic pressure brake line or pipe of the consist of a train. During an uncoupling operation, it is essential to electrically disconnect the trainline circuit contacts and to close or shut off the air pressure in the brake line before the actual physical separation of the cars takes place. In order to protect the electrical circuitry from being damaged and to prevent the air pressure from escaping to atmosphere, it is necessary to quickly open the multi-contact blocks carried by the coupler heads and to rapidly close a pneumatic shut-off valve also carried by the heads of the couplers. Thus, during an uncoupling operation, it is desirable to open the electrical contacts in order to minimize pitting or erosion due to arcing and to preserve fluid pressure for the purpose of centering the detached couplers on the respective cars. Further, it is highly desirable to be able to manually override the centering feature so that the couplers may be skewed to permit coupling on a turn or bend. In addition, it is necessary to convey air under pressure to the oncoming railway car so that the brake pipe and brake cylinders may be properly charged to effect appropriate braking operation upon request of the operator or engineer of the train. Moreover, the pneumatic centering devices must be automatically disabled so that the coupler of each of the coupled cars may freely move its axis of rotation as the train negotiates the bends or curves and the grade in the trackway.

SUMMARY AND OBJECTS OF THE INVENTION

Accordingly, it is an object of this invention to provide a unique tappet valve which may be used on automatic vehicle couplers.

Another object of this invention is to provide a new pneumatic control valve for use with a pneumatic actuated centering feature for center positioning an uncoupled coupler of a railway vehicle.

A further object of this invention is to provide a novel tappet control valve having an air pressure transfer feature for conveying air pressure from one car to another car when the cars are coupled.

Still another object of this invention is to provide an improved tappet valve assembly having a manual override for deactivating a pneumatic centering device for permitting railway cars to be coupled on a curve in the trackway.

Still a further object of this invention is to provide a new and improved tappet valve arrangement for railway car couplers which conveys pneumatic pressure from one car to another car when coupled and which interrupts the flow of the pneumatic pressure when the cars are uncoupled.

Yet another object of this invention is to provide a combination of a tappet valve assembly for at least a pair of automatic couplers of two adjacent railway cars comprising, a first control valve means for establishing a fluid flow connection between a car coupler on one railway car and a car coupler on another railway car when the railway cars are in a coupled state and for interrupting the fluid connection when the railway cars are in an uncoupled state, a second control valve means for supplying air pressure to an automatic pneumatic centering device when the coupler is in the uncoupled state, a third control valve means for overriding the automatic pneumatic centering device for permitting an uncoupled coupler to be moved off its center position, and a fourth control valve means for interrupting the fluid flow connection between the car couplers when it is desired to uncouple the railway car.

DESCRIPTION OF THE DRAWINGS

The above objects and other attendant features and advantages will be more readily appreciated as the present invention becomes better understood by reference to the following detailed description when considered in conjunction with the accompanying drawings, wherein.

DETAILED DESCRIPTION OF THE INVENTION

Figure 1:
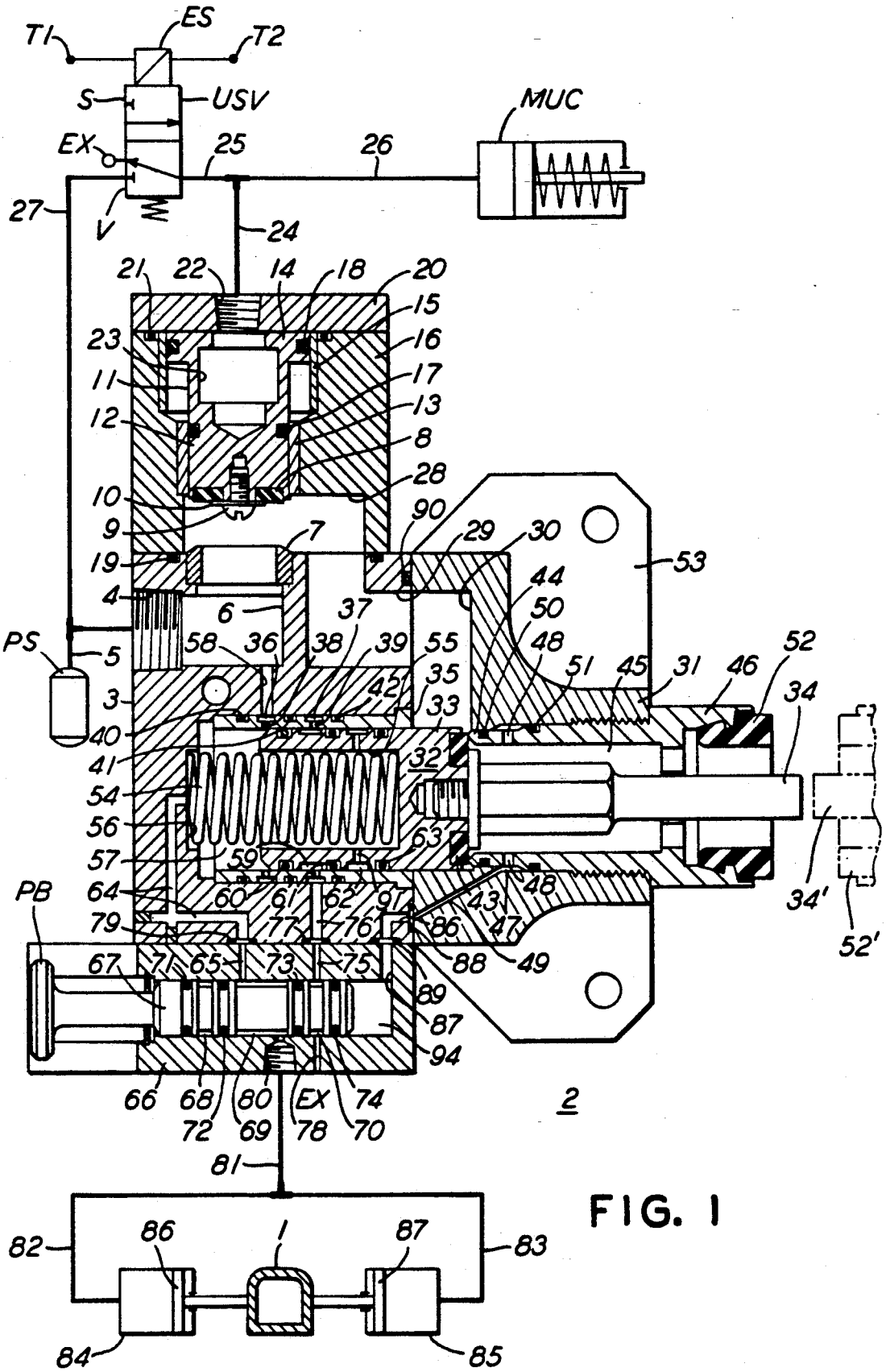
FIG. 1 is a schematic view, with the tappet valve assembly and coupler in section, of a railway car coupler in an uncoupled position embodying the present invention.

Referring now to the drawing, and in particular to the FIG. 1, there is shown a control system for an automatic railway car coupler arrangement in which the coupler 1 is illustrated in an uncoupled position. Ordinarily, when a railway vehicle is uncoupled, the tappet control valve assembly 2 assumes a position as shown in FIG. 1. It will be seen that the tappet valve 2 includes a main valve body member 3 having an input port 4 connected by air pipe 5 to a pneumatic pressure source, such as, a main reservoir PS. The input port 4 is connected by passageway 6 to a bushing type of valve seat 7. The upper surface of the cylindrical valve seat 7 of the side shut-off valve cooperates with a valve member 8 which is secured with a screw 9 and washer 10 to the underside of a slide or reciprocating piston member 11. The pneumatic movable piston 11 is a graduated member having a lower reduced portion 12 disposed in a lower valve sleeve 13 and having an upper enlarged portion 14 disposed in a upper valve sleeve 15. The sleeves 13 and 15 may be press-fit in the respective cylindrical cavities formed in the side shut-off valve body 16. An O-ring seal 17 is carried by the lower reduced portion 12, while an O-ring seal 18 is carried by the upper enlarged portion 14. A gasket or O-ring 19 is disposed between the top of the main valve body member 3 and the underside of the shut-off valve body member 16. A cover or cap member 20 is attached to the top of the shut-off valve body 16 by recessed Allen-head machine screws (not shown). A gasket or O-ring seal 21 is interposed between the underside of cover 20 and the top of the shut-off valve body 16 to provide an airtight seal. As shown, the cover member 20 includes a control port 22 leading to a pressure chamber 23 formed in the upper end of the graduated piston 12. The control port 22 is connected to conduit or pipe 24 which is connected to the output of an uncoupled solenoid valve USV via conduit or pipe 25. As shown in FIG. 1, the output of the uncouple valve device is also connected to a mechanical uncouple cylinder MUC via pipes 25 and 26. An uncouple solenoid valve device USV, which is symbolically represented in FIG. 1, normally occupies a vent position V as shown, in which pipe 27 leading to the main pressure supply reservoir PS is cut off and pipes 24, 25, and 26 are in communication with atmosphere via exhaust port EX of the valve device USV. The valve device USV is operable by an electrical solenoid ES, when energized, to supply position S in which pipe 27 supplies air pressure from main reservoir to pipes 25, 24, and 26, as will be described in more detail hereinafter.

It will be seen that air pressure in passageway 6 flows through the open shut-off valve into a passageway 28 formed in the shut-off valve body 16 and then into a passageway 29 formed in the main valve body 3. The passageway 29 leads into a passageway 30 formed in a front valve body 31. As shown, the main valve body 3 and the front valve body 31 are sealed by O-ring 90 when bolted together and are arranged to accommodate a piston and valve assembly 32 which includes a cylindrical piston head 33 and a threadedly secured piston stem 34. The piston head 33 is slidably disposed within a cylinder sleeve 35 inserted in the main valve body portion 3. The sleeve member 35 includes a pair of annular groove 36 and 37 as well as a plurality of peripherally spaced through holes 38 and 39. The annular groove 36 and the associated peripheral holes 38 are isolated or sealed by a pair of O-rings 40 and 41 while the annular groove 37 and the associated peripheral holes 35 are isolated or sealed by O-ring 41 and another O-ring 42. As previously mentioned, the tappet valve assembly 2 assumes a position as shown in FIG. 1 in which a first or main valve member 43 is seated on an annular valve seat 44 to close off the flow of air pressure from passageway 30 to a chamber or passageway 45 surrounding the stem 44. The annular valve seat 44 is located on the inner extremity of a cylindrical nose piece 46 which is internally disposed in the outer end of the front valve body 31. The cylindrical nose piece 46 includes an annular groove 47 and a plurality of peripheral through holes 48 which establishes communication between passageway 45 and passageway 49 formed in the front valve body 31 as will be described hereinafter. The annular groove 47 and the peripheral through holes 48 are isolated or sealed by a pair of axially disposed O-rings 50 and 51. The outer extremity of the nose piece 46 is provided with a doughnut-like resilient or rubber air coupling gasket 52 which will be described hereinafter. The front valve body portion 31 includes an apertured mounting flange member 53 which is employed to suitably fasten the tappet valve assembly 2 to the top of a railway car coupler 1 at each end of a railway car. It will be seen that a helical compression biasing spring 54 is disposed in a central cylindrical opening 55 in the rear end of piston 33 and is caged therebetween and a spring seat 56 formed in inner side wall of the main valve body 3. A pressure chamber 57 is connected to passageway 6 via a passageway 58, annular groove 36 and peripheral through holes 38. It will be seen that the piston head 33 includes an annular groove 59 which is isolated or sealed on either side by a pair of O-rings 60 and 61 and also includes an annular groove 62 which is sealed or isolated on either side by O-rings 61 and 63. A plurality of associated peripheral through holes 91 are in communication with annular groove 62. In the uncoupled position as shown in FIG. 1, the pressurized air in chamber 57 flows through a passageway 64 formed in the main valve body 3 to a passageway 65 formed in an override or negating valve body 66 which is bolted to the underside of the main valve body 3. An O-ring 79 provides an air-tight seal between the two passageways. As shown, a manual slide spool valve member 67 is disposed within the negating valve body 66. The cylindrical spool 67 includes a plurality of annular grooves, such as, grooves 68, 69, and 70 which are selectively in communication with certain passageways found in the negating valve body 66. It will be noted that the annular air passageway 68 is isolated or sealed on either side by a pair of O-rings 71 and 72 while the annular air passageway 70 is isolated or sealed on either side by a pair of O-rings 73 and 74. The central enlarged annular air passageway 69 is isolated or sealed on either side by O-rings 72 and 73. In viewing FIG. 1, it will be seen that a passageway 75 is formed in the negating valve body 66. The upper end of passageway 75 is in communication with a passageway 76 formed in the main valve body 3. An O-ring 77 provides an air-tight seal around the two communicating passageways 75 and 76. In the position shown, the annular groove 70 is aligned with passageway 78 which leads to exhaust port EX and, in turn, to atmosphere. It will be seen that the passageway 65 is in alignment with annular groove 69 which, in turn, is aligned with output port 80. The output port 80 is connected to a feed conduit or pipe 81. The feed pipe 81 leads to a pair of branch conduits or pipes 82 and 83. The branch pipe 82 is connected to a pneumatic cylinder 84 while the branch pipe 83 is connected to a pneumatic cylinder 85. The pneumatic cylinders 84 and 85 along with a respective piston 86 and 87 form a positioning or centering device which are located on opposite sides of the coupler 1 to normally place it in a center position when the railway car is normally uncoupled so that two adjacent railway cars may be automatically coupled on a tangent track.

Figure 2:
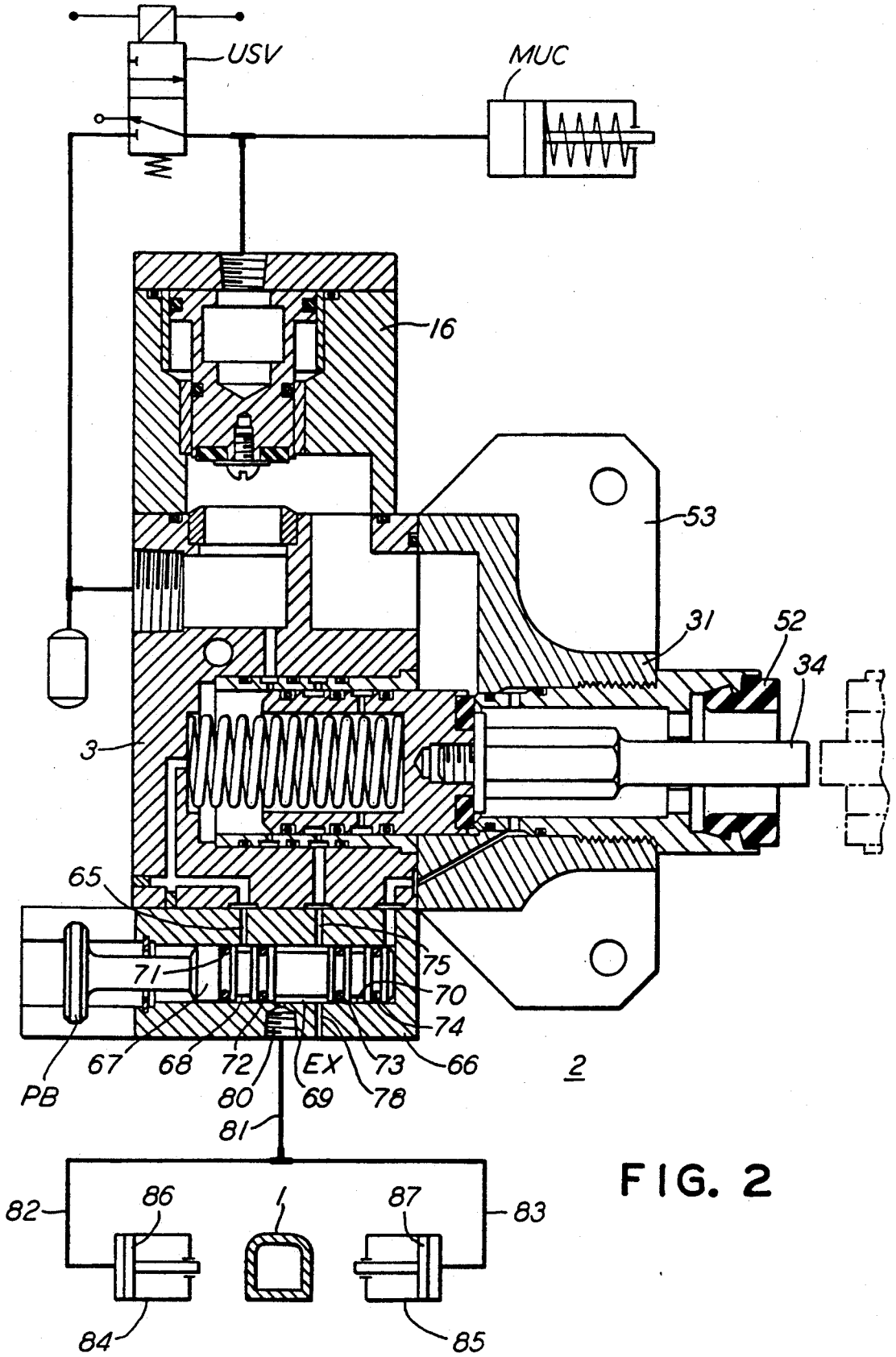
FIG. 2 is a similar view to FIG. 1 except that the center device is disabled.

However, when the cars are not sitting on a straight or tangent track, but in fact are sitting on a curved trackway, it is desirable to disable the centering device so that the coupler 1 may be horizontally swung to an appropriate position for permitting the coupling of two converging cars. The disabling operation may be readily initiated by a train crewman or operating personnel by manually depressing the push button or knob PB so that the spool valve 67 is shifted to its extreme righthand position as shown in FIG. 2. When the spool valve 67 occupies its righthand position, the air pressure in passageway 65 is entrapped by the annular groove 68 and O-rings 71 and 72. At the same time, the air pressure in the cylinders 84 and 85 is bled off through pipes 82, 83, and 81, through port 80, across the enlarged annular groove 69, through passageway 78, through exhaust port EX to atmosphere. Accordingly, the coupler 1 may be freely swung to the left or right to permit the alignment of mating car couplers to allow the coupling of the two abutting railway vehicles.

Figure 3:
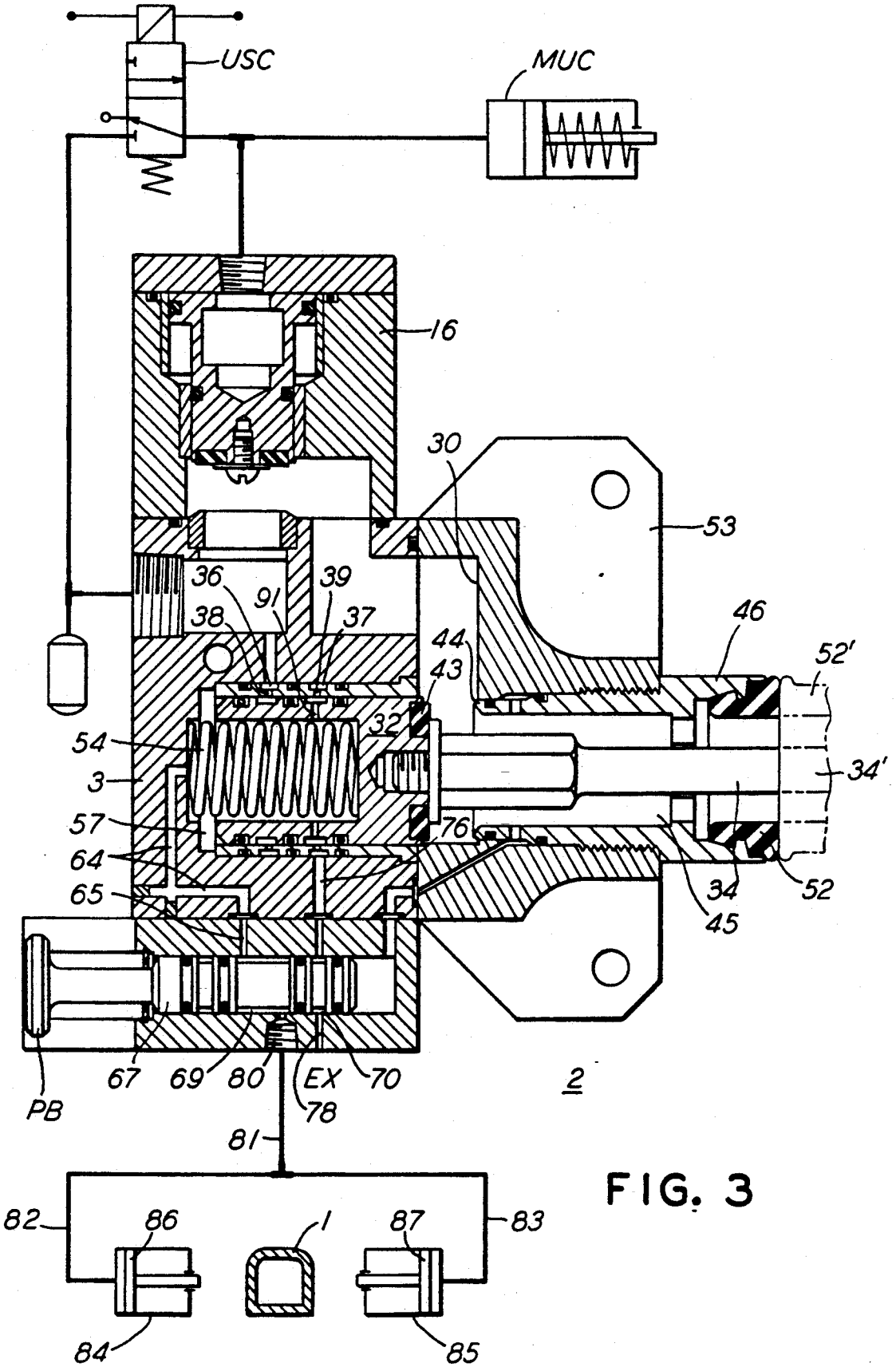
FIG. 3 is a similar view to FIG. 2 except that the coupler is in a coupled state.

Now as the cars come together, the tips of the valve stems 34 and 34' become engaged so that the piston and valve assembly is depressed, namely the piston and valve assembly 32 is moved to the left as viewed in FIG. 3. Thus, the valve member 43 is unseated from its seat 44 so that air pressure flowing from passageway 30 into chamber 45 may be conveyed to the subsequent adjoining car. It will be appreciated that the resilient or rubber gaskets 52 and 52' are slightly squeezed as the two vehicles are joined or coupled together so that an airtight seal is formed between the two car couplers. Further, it will be noted that the pressurization of chamber 45 automatically resets the overriding spool valve 67. That is, air pressure in chamber 45 flows through the peripheral ports 48 and the annular groove 47 formed in the nose piece 46 into the passageway 49 formed in the front valve body 31. It will be seen that the passageway 49 communicates with a passageway 86 formed in the main valve body 3 and, in turn, the passageway 86 communicates with a passageway 87 formed in the negating valve body 66. An O-ring 88 provides an airtight seal between the front valve body 31 and the main valve body 3 while an O-ring 89 provides an airtight seal between the main valve body 3 and the negating valve body 66. It will be noted that passageway terminates into an automatic reset chamber 94 which is located at the right end of spool valve 67. Thus, the pressurization of chamber 94 shifts the spool valve member to the left to its original position as shown in FIG. 1. However, the centering device is not reactivated at this time since the peripheral through holes 38 formed in the cylinder sleeve 35 are sealed on either side by a pair of O-rings 60 and 61. The pressure in piston chamber 57 is bled off to atmosphere through the exhaust port EX via peripheral through holes 91, annular groove 62, in the piston head 33, passageways 75 and 76, annular groove in the spool valve, and passageway 78. Thus, the pneumatic centering cylinders 84 and 85 are not pressurized so that the coupler 1 is free to swing from side to side as the railway vehicles negotiate and move through curves and bend in the trackway along the train's route of travel. The coupling equipment will remain in this condition so long as the cars are coupled together.

Figure 4:
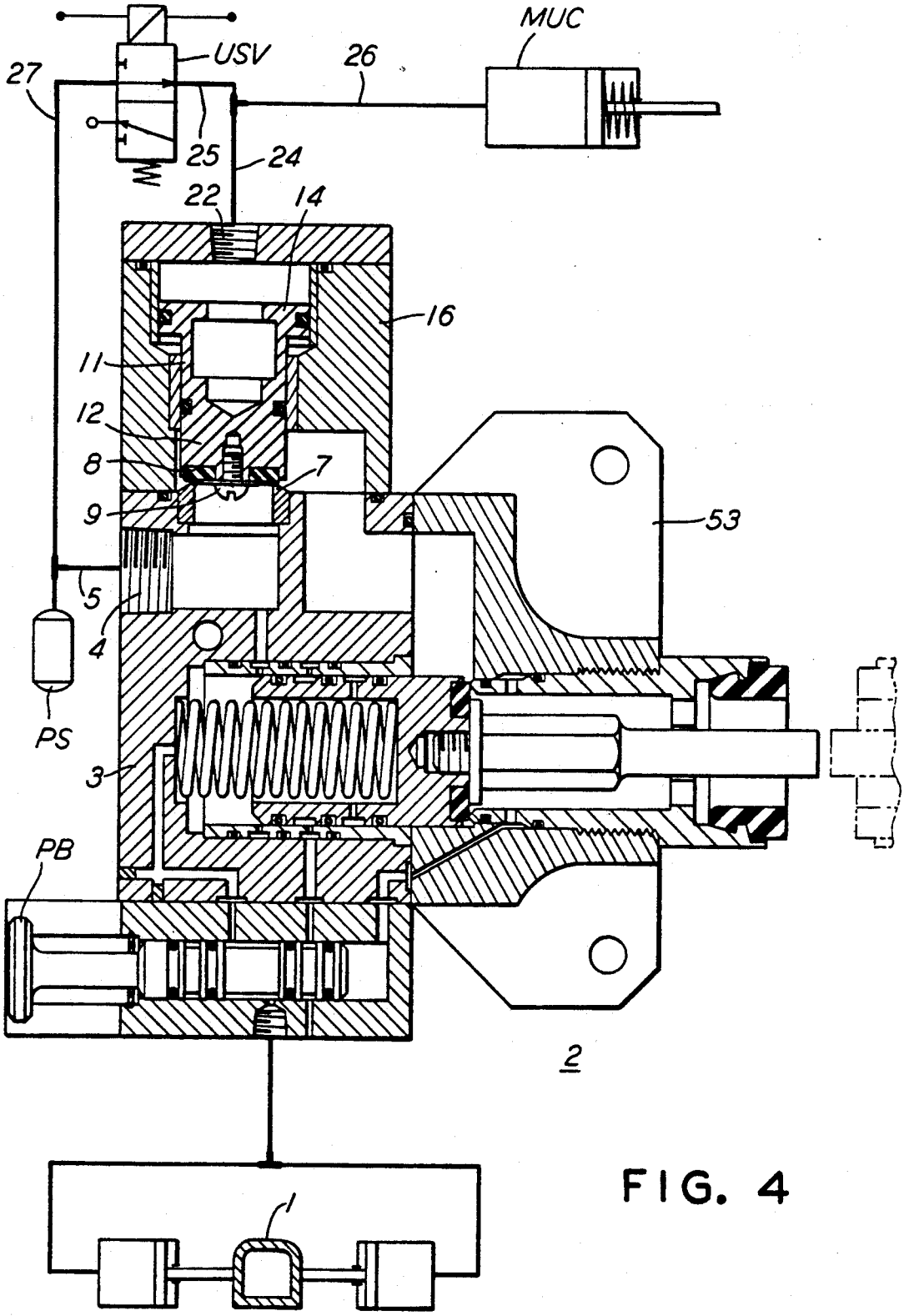
FIG. 4 is a schematic view which the uncoupling solenoid valve has initiated an uncoupling operation and the centering device is reactivated.

Let us now assume that it is desirable to remove one or more cars from the train, namely, it is necessary to uncouple one railway car from another railway car of a train. Under this condition, an operator simply energizes the electrical solenoid ES by closing a switch or the like in the cab of the car to supply a voltage across terminals T1 and T2. The energization of the solenoid ES causes the uncouple valve device USV to move from the vent position V to the supply position S so that the pipe 27 is connected to pipe 25. This initiates an uncoupling operation since air pressure flows from the main reservoir PS through pipe 27, through the supply portion S of valve USV, through pipes 25, 24 and 26. The pressure in pipe 26 causes the mechanical uncouple cylinder to unlatch a hook in the car coupler while the pressure in pipe 24 and chamber 23 causes the cylinder to move downward so that the valve member 8 becomes seated on valve seat 7, as shown in FIG. 4. This shuts off the supply of air pressure to the chamber 45 via passageways 28, 29, and 30. Now as the cars become separated, the ends of the stems 34 and 34' become disengaged so that the force of the compression spring 54 moves and returns the piston and valve assembly 32 to the position as shown in FIG. 1, 2 and 4. Thus, the valve member 43 is again seated on the valve 44 and the peripheral ports 38 are opened to chamber 57. Again, the air pressure flows to the chamber 57 via passageway 58, annular groove 36 and peripheral ports 38. In the uncouple position, the isolation annular groove 59 closes off the peripheral holes 39 and annular groove 37 formed in cylinder sleeve 35, passageways 87 and 75, annular groove 70 and passageway 78 to exhaust port EX. The buildup of pressure in chamber 57 causes air pressure to flow through passageways 64 and 65, across the enlarged annular groove 69, port 80 and pipes 81, 82 and 83 to pressurize the cylinders 84 and 85 to cause the pistons 86 and 87 of the centering device to move the coupler 1 to its center position.

Thus, the present invention employs a unique tappet valve assembly having a pneumatic centering device control feature for automatically centering an uncoupled railway car coupler and having a pneumatic pressure control transfer feature for conveying air pressure from one coupled car to another coupled car while providing a positive shut-off feature when the cars are uncoupled. The tappet valve assembly also includes a manual negating feature for overriding and disabling the pneumatic centering device for permitting the coupler to be swung from its center position for coupling on a curved track or for movement for maintenance purposes. That is, the tappet valve assembly includes a first control valve for establishing a pneumatic pressure connection from one railway vehicle to another railway vehicle when the vehicles are coupled together and for interrupting the flow of pressure prior to uncoupling. Further, the tappet valve assembly includes a second control valve for automatically supplying air pressure to a pneumatic center device when a vehicle coupler is in an uncoupled state and for automatically shutting off the air pressure to the centering device when the vehicle coupler is in a coupled state. The tappet valve assembly includes a third control valve which is capable of overriding the pneumatic centering device by venting the air pressure to atmosphere when the vehicle coupler is in an uncoupled state and for automatic resetting the third control valve when the vehicle coupler returns to a coupled state. The tappet valve assembly includes a fourth control for terminating the flow of pressure to the first control valve when it is desirable to uncouple the one vehicle from the other vehicle.

Thus, the present invention has been described in such full, clear, concise and exact terms as to enable any person skilled in the art to which it pertains to make and use the same, and having set forth the best mode contemplated of carrying out this invention. I state that the subject matter, which I regard as being my invention, is particularly pointed out and distinctly asserted in what is claimed. It will be understood that variations, modifications, equivalents and substitutions for components of the above specifically-described embodiment of the invention may be made by those skilled in the art without departing from the spirit and scope of the invention as set forth in the appended claims.

What I claim is:

1. A combination of a tappet valve assembly for at least a pair of automatic couplers of two adjacent railway cars comprising, a first control valve means for establishing a fluid flow connection between a car coupler on one railway car and a car coupler on another railway car when in a coupled state and for interrupting the fluid connection when the railway cars are in an uncoupled state, a second control valve means for supplying air pressure to an automatic pneumatic centering device when the coupler is in the uncoupled state, a third control valve means for overriding said automatic pneumatic centering device for permitting an uncoupled coupler to be moved off its center position, and a fourth control valve means for interrupting the fluid flow connection between the car couplers when it is desired to uncouple the railway cars.

2. The combination of a tappet valve assembly as defined in claim 1, wherein said first control valve means includes a valve seat formed on the inner end of a cylindrical nose piece and a valve member carried by a main piston head.

3. The combination of a tappet valve assembly as defined in claim 1, when said second control valve means includes a cylindrical sleeve having a plurality of isolated annular and peripheral through holes which are opened and closed by a piston head having a plurality of isolated annular groove and peripheral through holes.

4. The combination of a tappet valve assembly as defined in claim 1, wherein said third control valve means includes a manually operable spool valve which normally supplies air pressure to said pneumatic centering device and which shuts off the air pressure and vents said pneumatic centering device to atmosphere.

5. The combination of a tappet valve assembly as defined in claim 1, wherein said fourth control valve means includes a pneumatically operable piston valve member which is adapted to be seated on an annular valve seat when it is desired to uncouple the railway car.

6. The combination of a tappet valve assembly as defined in claim 1, wherein said first control valve means positively shuts off air pressure to the car coupler of another railway car prior to separation of car couplers.

7. The combination of a tappet valve assembly as defined in claim 2, wherein said main piston head is biased by a compression spring to urge said valve member against said valve seat.

8. The combination of a tappet valve assembly as defined in claim 6, wherein said main piston head is connected to a piston stem which is depressed to unseat said valve member from said valve seat when the car couplers are coupled.

9. The combination of a tappet valves assembly as defined in claim 3, wherein said grooves and through hole on said cylindrical sleeve are isolated by a pair of O-rings.

10. The combination of a tappet valve assembly as defined in claim 3, wherein said grooves and through holes on said piston head are isolated by a pair of O-rings.

11. The combination of a tappet valve assembly as defined in claim 4, wherein said spool valve includes an external push knob for depressing said spool valve.

12. The combination of a tappet valve assembly as defined in claim 4, wherein said spool valve includes a plurality of pneumatically isolated annular grooves.

13. The combination of a tappet valve assembly as defined in claim 12, wherein each of said annular grooves is isolated by a pair of O-rings.

14. The combination of a tappet valve assembly as defined in claim 5, wherein said pneumatically operable piston valve member of said fourth control valve means is disposed in a graduated cylinder located in shut-off valve body.

15. The combination of a tappet valve assembly as defined in claim 3, wherein said cylindrical sleeve is mounted in a main valve body.

16. The combination of a tappet valve assembly as defined in claim 2, wherein said cylindrical noses piece is mounted in a front valve body.

17. The combination of a tappet valve assembly as defined in claim 4, wherein said spool valve is mounted in a negating valve body.

18. The combination of a tappet valve assembly as defined in claim 5, wherein said pneumatically operable piston valve member is controlled by a solenoid valve which supplies pressure from a source of air supply.

19. The combination of a tappet valve assembly as defined in claim 2, wherein a resilient gasket is located at the outer end of said cylindrical nose piece.

20. The combination of a tappet valve assembly as defined in claim 1, wherein said automatic pneumatic centering device includes a pair of pistons and cylinders.

21. The combination of a tappet valve assembly as defined in claim 4, wherein said spool valve is automatically reset to its normal position when the car coupler is in a coupled state.

* * * * *